United States Patent [19]

Kennedy

[11] 4,311,767

[45] Jan. 19, 1982

[54] GYPSUM WALLBOARD AND METHOD FOR PRODUCING SAME

[75] Inventor: Arthur E. Kennedy, North Tonawanda, N.Y.

[73] Assignee: National Gypsum Company, Dallas, Tex.

[21] Appl. No.: 124,106

[22] Filed: Feb. 25, 1980

[51] Int. Cl.[3] ..... B32B 21/04

[52] U.S. Cl. ..... 428/537; 156/44; 162/128; 427/391; 428/703

[58] Field of Search ..... 260/346.74, 345.9 R; 428/537, 543, 538, 539, 703; 427/391; 156/39, 44, 45; 162/128, 168

[56] References Cited

U.S. PATENT DOCUMENTS

| | | | |
|---|---|---|---|
| 3,102,064 | 8/1963 | Wurzburg et al. | 162/158 |
| 3,139,373 | 6/1964 | Liggett | 162/158 |
| 3,300,371 | 1/1967 | Hart | 162/128 |
| 3,389,042 | 6/1968 | Bieri et al. | 428/342 |
| 3,821,069 | 6/1974 | Wurzburg | 162/158 |
| 3,968,005 | 7/1976 | Wurzburg | 162/158 |

*Primary Examiner*—James J. Bell

*Attorney, Agent, or Firm*—Robert F. Hause

[57] ABSTRACT

A paper-covered gypsum core wallboard made of a cover paper having on the inner surface a synthetic size of the class consisting of certain substituted succinic acid anhydrides, certain substituted glutaric acid anhydrides and the reaction product of maleic anhydride and an internal olefin, which reduces the absorption by the paper of components of the wet gypsum slurry, without affecting substantially the paper porosity, and, of prime importance, without any deleterious effect on the bond of the paper to the gypsum core, either prior to the drying of the board or after the drying of the board.

10 Claims, No Drawings

GYPSUM WALLBOARD AND METHOD FOR PRODUCING SAME

This invention relates to an improved gypsum board, and to the new and unobvious method of making the improved gypsum board.

In U.S. Pat. No. 3,389,042, a new method of surface sizing the inner surface, or the bottom liner ply, of paper for use in making gypsum wallboard is disclosed, wherein silicone resins are applied in an amount sufficient to produce a Cobb value of only about 0.4 to 1.0 gram. Generally it had been considered necessary theretofor to provide considerably greater absorption in order to obtain good bond of the gypsum core to the paper, during the setting of the gypsum, drying of the board and thereafter.

A Cobb value is a measure of water absorption as measured by a Cobb's test. The Cobb's test follows the general test outlined by T.A.P.P.I. but is modified as follows: In conducting this test, a 5"×5" sample of the paper to be tested is conditioned at 150° F. for 20 minutes and cooled in a desiccator. Upon removal from the desiccator, it is weighed rapidly on a balance to the nearest 0.01 gm. This is the "dry weight". The sample is then clamped in a standard 100 sq. cm. Cobb ring (manufactured by W. and L. E. Gurley Instrument Co.) having an area of 100 square centimeters with the paper surface to be tested exposed. The Cobb ring is preheated to 100°-120° F. prior to conducting the test in order to prevent rapid cooling of the test water. 150 ml. of clean tap water at 120° F. is then poured into the Cobb ring, covering the surface of the paper sample to be tested. A timer is started as soon as the water is poured into the ring. After the water has been in contact with the paper for exactly 3 minutes, the water is poured out of the ring. As rapidly as possible, the paper sample is removed from the ring, blotted "dry" of surface water with a highly absorbent blotter or paper towel, folded into quarters to reduce weight loss from evaporation, and reweighed to the nearest 0.01 gm. This is the "wet weight." (This last sequence of steps should not exceed 15-30 seconds). The Cobb value is determined by subtracting the "dry weight" from the "wet weight."

Silicone resins are relatively expensive sizing agents. Considerable effort has been expended by the industry in an effort to find a lower cost sizing agent which provided the unique qualities of the silicone resin. All of the common paper sizing agents in use prior to the '042 patent have been found to be apparently incapable of commercial use on the bond liner surface of wallboard paper at loadings which would produce a Cobb value of about 0.4-1.0. When used at such loadings, an unacceptably low degree of bond of paper to gypsum is obtained either during manufacture or subsequent to manufacture or both.

The present invention relates to the use of a synthetic size of the class consisting of substituted succinic acid anhydride, substituted glutaric acid anhydride and the reaction produce of maleic anhydride and an internal olefin, as a bottom surface size on paper for use in making gypsum wallboard.

It is an object of the present invention to provide a new and distinctly different class of sizing agents to be used at the inner surface of the bond liner ply of gypsum wallboard paper.

It is a further object to provide a novel surface sizing for gypsum wallboard paper having advantageous characteristics when applied to create Cobb values of 0.4-1.0.

These and other objects and advantages of the invention will be more readily apparent when considered in relation to the preferred embodiments of the invention as set forth in the following specification.

In accordance with the invention, gypsum wallboard is made in the usual two-step operation. First a paper cover sheet is made, generally a multi-ply sheet manufactured on a cylinder machine, which employs several vats, each containing a cylindrical screen, and each forming one of the several plies of the paper sheet. Conventional sizing compounds, such as rosin and alum are added to selected vats to properly internally size some or all plies. The several plies are removed from the cylinders and laminated to form an essentially unitary web of paper of about 0.015 to 0.025 inch thickness.

In the gypsum board plant, as a second step, an aqueous slurry of settable gypsum plaster is placed between two paper cover sheets. After partially hardening, the continuous web of board is cut into desired lengths and dried in a high temperature kiln.

The paper ply of the multi-ply cover sheet directly adjacent the plaster core is known as the bond-ply or core-side ply. It has generally always been considered essential to permit water absorption from the gypsum slurry into at least the bond-ply, whereby dissolved gypsum is carried therein to provide a mechanical linking of the paper to the gypsum core when the dissolved gypsum dries and forms gypsum crystals. It has been found clearly advantageous to maintain this absorption to the minimum amount which will still permit good bond of the paper to the gypsum at all stages of manufacture and thereafter.

In accordance with the invention, this absorption is kept to an acceptable minimum by treating the inner surface of the paper cover sheet with a synthetic size of the class consisting of certain substituted succinic acid anhydrides, certain substituted glutaric acid anhydrides and the reaction product of maleic acid anhydride with an internal olefin.

This class of sizing agents is thoroughly described in U.S. Pat. Nos. 3,102,064 and 3,821,069 and accordingly Nos. 3,102,064 and 3,821,069 are embodied herein by the reference. Both the '064 and the '069 patents teach that the synthetic sizes disclosed herein are advantageous if added at any point in the paper making process prior to the ultimate conversion of the wet pulp into a dry web or sheet, such as while the pulp is in the head box, beater, hydropulper or stock chest.

In the present invention, the paper cover sheets, to be used in gypsum wallboard manufacture, are completely formed by any standard paper-forming process. Most commonly this will be by forming a multi-ply paper sheet on a cylinder machine. The paper, after being partially or completely dried, is coated with a water emulsion of the synthetic size of the class consisting of certain substituted succinic acid anhydrides, certain substituted glutaric acid anhydrides and the reaction product of maleic anhydride with an internal olefin.

The maleic acid anhydride embodiment may be further defined as a sizing agent which comprises the reaction product of maleic acid anhydride with an internal olefin corresponding to the formula $$R_x—CH_2—CH=CH—CH_2—R_y$$

wherein $R_x$ is an alkyl radical containing at least four carbon atoms and $R_y$ is an alkyl radical containing at least four carbon atoms, the resultant sizing agent being more effective than sizing agents prepared employing olefins having the double bond in the 1, 2 or 3 position of the short chained branched olefins.

In a preferred embodiment, an aqueous emulsion of a dicarboxylic acid anhydride with a long hydrophobic side chain, as shown

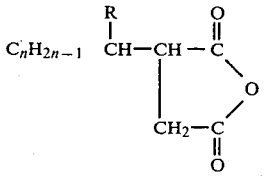

available as Fibran 68, a trademark of National Starch and Chemical Corp., is applied as a thin coating on the bottom, or core side, face of the paper cover sheet. The amount of water dilution of the emulsion will determine the rate at which the novel synthetic surface sizing material solids are applied to the paper surface.

A suitable amount of dilution is used to produce surface size coating of about 1 lb. per ton of 60 lb/M sq. ft. gypsum board paper, under a standard set of conditions using a 1.15% solids emulsion. The Cobb value of the coated paper was 0.6 gram, a suitably low Cobb value.

This relatively high water repellency was surprisingly not deleterious to the porosity of the paper nor, thus, the ability of a newly formed wallboard, with this paper, to dry. The wet and dry bond of the paper to a gypsum core was good. The cost of this method of sizing compared to the prior silicone surface sizing was approximately 30% lower.

The class of sizing agents contemplated within the present invention also includes sizing agents corresponding to the following structural formula:

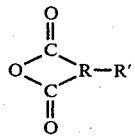

wherein R represents a dimethylene or trimethylene radical and wherein R′ is a hydrophobic group containing more than five carbon atoms which may be selected from the class consisting of alkyl, alkenyl, aralkyl or aralkenyl groups. Substituted cyclic dicarboxylic acid anhydrides falling within the above-described formula are the substituted succinic and glutaric acid anhydrides. Thus the invention further contemplates the use of iso-octadecenyl succinic acid anhydride, n-hexadecenyl succinic acid anhydride, dodecenyl succinic acid anhydride, triisobutenyl succinic acid anhydride and their equivalents as surface sizing agents on the bottom, or core side, face of gypsum wallboard paper cover sheets, in sufficient quantity to produce a Cobb value of about 0.4 to 1.0 gram measured on the bottom surface of the paper.

Having completed a detailed disclosure of the preferred embodiments of my invention, so that others may practice the same, I contemplate that variations may be made without departing from the essence of the invention or the scope of the appended claims.

I claim:

1. Paper-covered gypsum board which comprises a gypsum core and a paper cover sheet covering at least one side of said core, said paper cover sheet having a synthetic size applied to the paper surface adjacent said core, said synthetic size being of the group consisting of (1) a cyclic dicarboxylic acid anhydride corresponding to the structural formula

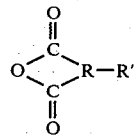

wherein R is selected from the class consisting of dimethylene and trimethylene radicals and wherein R′ is a long hydrophobic side chain and is selected from the class of alkyl, alkenyl, aralkyl and aralkenyl groups and (2) the reaction product of maleic acid anhydride and an internal olefin in an amount sufficient to attain in said sheet, when said board is manufactured, a Cobb value of about 0.4 to 1.0 gram as measured on the surface of said sheet adjacent said core.

2. A paper-covered gypsum board according to claim 1 wherein said sheet contains about one pound of said synthetic size per ton of paper.

3. A paper-covered gypsum board according to claim 1 wherein said synthetic size is a dicarboxylic acid anhydride.

4. A paper-covered gypsum wallboard according to claim 3 wherein said dicarboxylic acid anhydride has a long hydrophobic side chain containing more than five carbon atoms, and structured as follows:

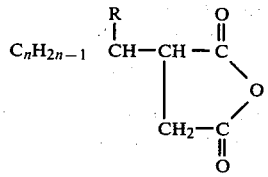

5. A paper-covered gypsum wallboard according to claim 1 wherein said synthetic size comprises the reaction product of maleic anhydride with an internal olefin corresponding to $$R_x—CH_2—CH=CH—CH_2—R_y$$

wherein $R_x$ is an alkyl radical containing at least four carbon atoms and $R_y$ is an alkyl radical containing at least four carbon atoms.

6. A method of making paper-covered gypsum board which comprises forming a core of cementitious gypsum slurry, laminating said core with a paper sheet having a synthetic size coated on the face adjacent said core, said synthetic size being of the group consisting of (1) a cyclic dicarboxylic acid anhydride corresponding to the structural formula

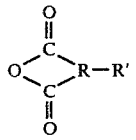

wherein R is selected from the class consisting of dimethylene and trimethylene radicals and wherein R' is a long hydrophobic side chain and is selected from the class of alkyl, alkenyl, aralkyl and aralkenyl groups and (2) the reaction product of maleic acid anhydride and an internal olefin in an amount sufficient to attain in said sheet a Cobb value of about 0.4 to 1.0 gram as measured on the surface of said sheet adjacent said core, and drying said gypsum board.

7. The method according to claim 6 wherein said size is coated on said paper face at a rate of about one pound per ton of paper.

8. The method according to claim 6 wherein said synthetic size is a dicarboxylic acid anhydride.

9. The method according to claim 8 wherein dicarboxylic acid anhydride has a long hydrophobic side chain containing more than five carbon atoms, and structured as follows:

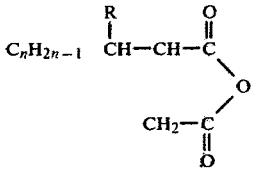

10. The method according to claim 6 wherein said synthetic size comprises the reaction product of maleic anhydride with an internal olefin corresponding to $$R_x—CH_2—CH=CH—CH_2—R_y$$

wherein $R_x$ is an alkyl radical containing at least four carbon atoms and $R_y$ is an alkyl radical containing at least four carbon atoms.

* * * * *